US007906013B2

(12) United States Patent
Kokayeff et al.

(10) Patent No.: US 7,906,013 B2
(45) Date of Patent: Mar. 15, 2011

(54) HYDROCARBON CONVERSION PROCESS

(75) Inventors: Peter Kokayeff, Naperville, IL (US); Laura E. Leonard, Western Springs, IL (US); Michael R. Smith, Rolling Meadows, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 12/704,780

(22) Filed: Feb. 12, 2010

(65) Prior Publication Data

US 2010/0155294 A1 Jun. 24, 2010

Related U.S. Application Data

(63) Continuation-in-part of application No. 11/618,623, filed on Dec. 29, 2006, now abandoned.

(51) Int. Cl.
*C10G 65/10* (2006.01)

(52) U.S. Cl. ..... 208/49; 208/46; 208/58; 208/59; 208/208 R; 208/209; 208/210; 208/211; 208/243; 208/244

(58) Field of Classification Search ..... 208/46, 208/49, 58–59, 88–89, 107–108, 112, 208 R, 208/209–211, 243–244
See application file for complete search history.

(56) References Cited

U.S. PATENT DOCUMENTS

| | | | |
|---|---|---|---|
| 2,878,179 | A | 3/1959 | Hennig |
| 3,130,006 | A | 4/1964 | Rabo et al. |
| 3,328,290 | A | 6/1967 | Hengstebeck |
| 3,623,974 | A | 11/1971 | Mounce et al. |
| 3,668,112 | A | 6/1972 | Parker et al. |
| 3,730,880 | A | 5/1973 | Van der Toorn et al. |
| 4,363,718 | A | 12/1982 | Klotz |
| 4,419,220 | A | 12/1983 | LaPierre et al. |
| 4,501,926 | A | 2/1985 | LaPierre et al. |
| 4,554,065 | A | 11/1985 | Albinson et al. |
| 4,676,887 | A | 6/1987 | Fischer et al. |
| 4,678,764 | A | 7/1987 | Le et al. |
| 4,683,214 | A | 7/1987 | Angevine et al. |
| 4,689,138 | A | 8/1987 | Miller |
| 4,738,766 | A | 4/1988 | Fischer et al. |
| 4,788,378 | A | 11/1988 | Chang et al. |
| 4,789,457 | A | 12/1988 | Fischer et al. |
| 4,828,677 | A | 5/1989 | Fischer et al. |
| 4,855,530 | A | 8/1989 | LaPierre et al. |

(Continued)

FOREIGN PATENT DOCUMENTS

EP 0225053 A1 10/1987

(Continued)

OTHER PUBLICATIONS

U.S. Appl. No. 11/300,007, filed Dec. 14, 2005, Leonard.

(Continued)

*Primary Examiner* — Walter D Griffin
*Assistant Examiner* — Brian McCaig
(74) *Attorney, Agent, or Firm* — James C Paschall

(57) ABSTRACT

A process is provided to produce an ultra low sulfur diesel with less than about 10 ppm sulfur using a two-phase or liquid-phase continuous reaction zone to convert a diesel boiling range distillate preferably obtained from a mild hydrocracking unit. In one aspect, the diesel boiling range distillate is introduced once-through to the liquid-phase continuous reaction zone over-saturated with hydrogen in an amount effective so that the liquid phase remains substantially saturated with hydrogen throughout the reaction zone as the reactions proceed.

15 Claims, 1 Drawing Sheet

U.S. PATENT DOCUMENTS

| | | | |
|---|---|---|---|
| 4,859,311 | A | 8/1989 | Miller |
| 4,867,862 | A | 9/1989 | Ziemer |
| 4,919,789 | A | 4/1990 | Fischer et al. |
| 4,921,594 | A | 5/1990 | Miller |
| 4,943,366 | A | 7/1990 | Fischer et al. |
| 4,954,241 | A | 9/1990 | Kukes et al. |
| 4,960,504 | A | 10/1990 | Pellet et al. |
| 4,962,269 | A | 10/1990 | LaPierre et al. |
| 5,082,986 | A | 1/1992 | Miller |
| 5,114,562 | A | 5/1992 | Haun et al. |
| 5,135,638 | A | 8/1992 | Miller |
| 5,149,421 | A | 9/1992 | Miller |
| 5,246,566 | A | 9/1993 | Miller |
| 5,282,958 | A | 2/1994 | Santilli et al. |
| 5,403,469 | A | 4/1995 | Vauk et al. |
| 5,403,470 | A | 4/1995 | Kokayeff et al. |
| 5,527,448 | A | 6/1996 | Morel et al. |
| 5,718,820 | A | 2/1998 | Morel et al. |
| 5,720,872 | A | 2/1998 | Gupta |
| 5,833,837 | A | 11/1998 | Miller |
| 5,904,835 | A | 5/1999 | Thakkar |
| 5,976,351 | A | 11/1999 | Apelian et al. |
| 5,980,729 | A | 11/1999 | Kalnes et al. |
| 6,106,694 | A | 8/2000 | Kalnes et al. |
| 6,123,835 | A | 9/2000 | Ackerson et al. |
| 6,200,462 | B1 | 3/2001 | Cash et al. |
| 6,217,746 | B1 | 4/2001 | Thakkar et al. |
| 6,221,239 | B1 | 4/2001 | Morel et al. |
| 6,294,080 | B1 | 9/2001 | Thakkar et al. |
| 6,387,245 | B1 | 5/2002 | Kalnes et al. |
| 6,402,935 | B1 | 6/2002 | Kalnes |
| 6,428,686 | B1 | 8/2002 | Ackerson et al. |
| 6,444,116 | B1 | 9/2002 | Galiasso et al. |
| 6,497,813 | B2 | 12/2002 | Ackerson et al. |
| 6,638,419 | B1 | 10/2003 | Da Silva et al. |
| 6,645,371 | B2 | 11/2003 | Vuillemot et al. |
| 6,689,273 | B1 | 2/2004 | Kalnes et al. |
| 6,702,935 | B2 | 3/2004 | Cash et al. |
| 6,881,326 | B2 | 4/2005 | Ackerson et al. |
| 6,890,425 | B2 | 5/2005 | Ackerson et al. |
| 6,929,738 | B1 | 8/2005 | Riley et al. |
| 7,041,211 | B2 | 5/2006 | Kalnes |
| 7,074,320 | B2 | 7/2006 | Miller |
| 7,078,439 | B2 | 7/2006 | Odueyungbo et al. |
| 7,094,332 | B1 | 8/2006 | Kalnes et al. |
| 7,097,815 | B2 | 8/2006 | Dassori et al. |
| 7,156,977 | B2 | 1/2007 | Wrisberg et al. |
| 7,238,277 | B2 | 7/2007 | Dahlberg et al. |
| 7,354,462 | B2 | 4/2008 | O'Rear |
| 2002/0148755 | A1 | 10/2002 | Ackerson et al. |
| 2004/0159582 | A1 | 8/2004 | Simmons et al. |
| 2005/0010076 | A1 | 1/2005 | Wasserscheid et al. |
| 2005/0082202 | A1 | 4/2005 | Ackerson et al. |
| 2006/0118464 | A1 | 6/2006 | Kalnes |
| 2006/0144756 | A1 | 7/2006 | Ackerson et al. |
| 2008/0023372 | A1 | 1/2008 | Leonard et al. |
| 2008/0159928 | A1 | 7/2008 | Kokayeff et al. |
| 2009/0095651 | A1 | 4/2009 | Leonard et al. |
| 2009/0095652 | A1 | 4/2009 | Kokayeff et al. |
| 2009/0095653 | A1 | 4/2009 | Kokayeff et al. |
| 2009/0095655 | A1 | 4/2009 | Kokayeff et al. |
| 2009/0095656 | A1 | 4/2009 | Kokayeff et al. |
| 2009/0321310 | A1 | 12/2009 | Kokayeff et al. |
| 2009/0321319 | A1 | 12/2009 | Kokayeff et al. |

FOREIGN PATENT DOCUMENTS

| | | | |
|---|---|---|---|
| EP | 0993498 | B1 | 8/2004 |
| WO | 9613563 | A1 | 5/1996 |
| WO | 9626993 | A1 | 9/1996 |
| WO | 0034416 | A1 | 6/2000 |

OTHER PUBLICATIONS

U.S. Appl. No. 12/495,601, filed Jun. 30, 2009, Petri.

Office Action dated Jun. 4, 2009 in U.S. Appl. No. 11/460,307, Leonard.

Applicants' Sep. 4, 2009 Response to the Jun. 4, 2009 Office Action in U.S. Appl. No. 11/460,307, Leonard.

Office Action dated Dec. 15, 2009 in U.S. Appl. No. 11/872,084, Leonard.

Applicants' Mar. 15, 2010 Response to the Dec. 15, 2009 Office Action in U.S. Appl. No. 11/872,084, Leonard.

Office Action dated Oct. 5, 2009 in U.S. Appl. No. 11/872,312, Kokayeff.

Applicants' Jan. 5, 2010 Response to the Oct. 5, 2009 Office Action in U.S. Appl. No. 11/872,312, Kokayeff.

Office Action dated Apr. 12, 2010 in U.S. Appl. No. 11/872,312, Kokayeff.

Applicants' Jul. 1, 2010 Response to the Apr. 12, 2010 Office Action in U.S. Appl. No. 11/872,312, Kokayeff.

U.S. Appl. No. 12/495,574, filed Jun. 30, 2009, Petri.

Ronze, "Hydrogen solubility in straight run gasoil", Chemical Engineering Science 57 (2002) 547-553.

Wache, "Improved deep desulphurisation of middle distillates by a two-phase reactor with pre-saturator", Fuel 85 (2006) 1483-1493.

Boesmann, "Deep desulfurization of diesel fuel by extraction with ionic liquids", Chem. Commun., 2001, 2494-2495.

Datsevitch, "Improvement of the Deep Desulphurization of Diesel Oil by Pre-saturation and a Recycle of the Liquid Phase", DGMK Tagungsbericht, 2003, pp. 321-328, Chemical Abstracts 140(15/16), Abstract No. 255917 (2004).

Gatte, "Hydrogen Processing. Hydrotreating. General Process", National Petrochemical and Refiners Association, 1999 NPRA Question and Answer Session on Refining and Petrochemical Technology, Washington, DC, pp. 140-158.

Gudde, "Improving deep sulfur removal from motor fuels by the use of a pre-saturator and a liquid circuit", Chemie-Ingenieur-Technik 75(8) 2003, p. 1040, and English language abstract.

Johnson, "Weigh Options for Meeting Future Gasoline Sulfur Specifications", Harts' Fuel Techology & Management, vol. 7, No. 2, pp. 16,18 (Mar. 1997).

Schmitz, "Deep desulfurization of diesel oil: kinetic studies and process-improvement by the use of a two-phase reactor with pre-saturator", Chemical Engineering Science 59 (2004) 2821-2829.

Stratiev, "Investigation on the Effect of Heavy Diesel Fraction Properties on Product Sulphur during Ultra Deep Diesel Hydrodesulphurization", Erdol Erdgas Kohle, vol. 122, No. 2, 2006, pp. 59-60, 62-63, Urban Verlag Hamburg/Wien GmbH, Germany.

Office Action dated Jun. 12, 2009 in U.S. Appl. No. 11/618,623, Kokayeff.

Applicants' Sep. 11, 2009 Response to the Jun. 12, 2009 Office Action in U.S. Appl. No. 11/618,623, Kokayeff.

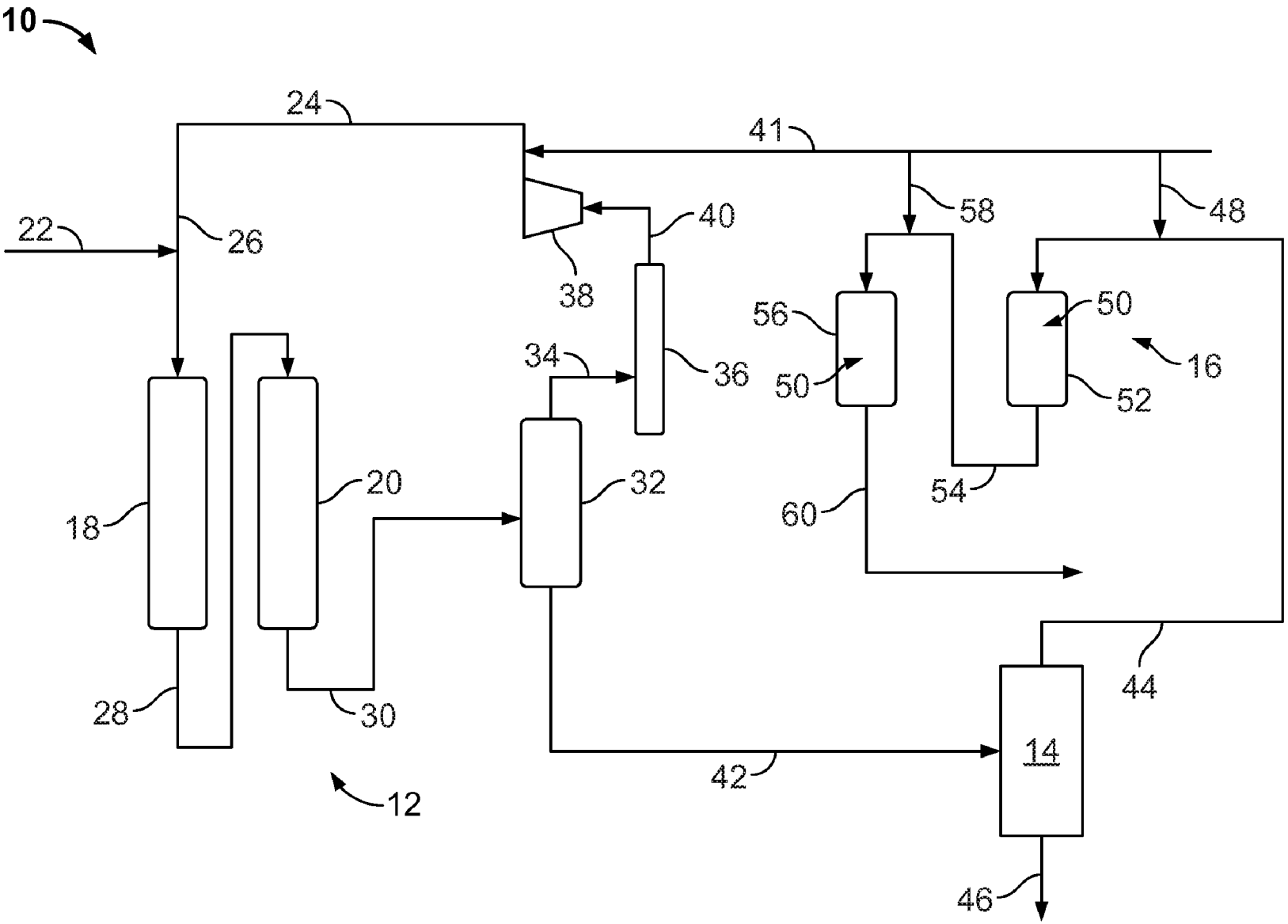
10
22
24
26
18
28
20
30
12
34
32
38
40
36
41
56
50
60
58
54
50
52
16
48
42
14
46
44

HYDROCARBON CONVERSION PROCESS

CROSS-REFERENCE TO RELATED APPLICATION

This application is a continuation-in-part of U.S. patent application Ser. No. 11/618,623, filed Dec. 29, 2006, now abandoned, the contents of which are hereby incorporated by reference in its entirety.

FIELD

The invention relates to a hydrocarbon conversion process for the production of low or ultra low sulfur hydrocarbons. In particular, the invention relates to a hydrocarbon conversion process including a liquid-phase reaction zone.

BACKGROUND

It has been recognized that due to environmental concerns and newly enacted rules and regulations, saleable petroleum products must meet lower and lower limits on contaminates, such as sulfur and nitrogen. New regulations require essentially complete removal of sulfur from liquid hydrocarbons that are used in transportation fuels, such as gasoline and diesel. For example, ultra low sulfur diesel (ULSD) requirements are typically less than about 10 ppm sulfur.

A mild hydrocracking unit, which often includes a hydrotreating zone and a hydrocracking zone, is one method to produce diesel boiling range hydrocarbons with a reduced level of sulfur. However, typical mild hydrocracking units generally cannot produce diesel meeting the ultra low sulfur requirements with acceptable cetane numbers. For example, product from a common mild hydrocracking unit still has about 100 to about 2000 ppm of sulfur and a relatively low cetane number of about 30 to about 40.

Attempts to improve the quality of the effluent from the mild hydrocracking unit are known, but do so at the expense of overtreating the higher boiling components or through additional high pressure vessels. Overtreated higher boiling components are generally not suitable for subsequent fluid catalytic cracking. Additional high pressure vessels require a large capital investment and are more costly to operate. Moreover, the hydrogen requirements for these additional high pressure vessels also require a costly recycle gas compressor, which also adds further capital investment and operating costs. For example, a typical high pressure vessel added to a mild hydrocracking unit typically requires a relatively large portion of the hydrogen recycle gas (up to about 10,000 SCF/B, for instance).

Other attempts to reduce the sulfur content of hydrocarbonaceous streams employ a two-phase reactor (i.e., liquid hydrocarbon stream and solid catalyst) with pre-saturation of hydrogen. See, e.g., Schmitz, C. et al., "Deep Desulfurization of Diesel Oil: Kinetic Studies and Process-Improvement by the Use of a Two-Phase Reactor with Pre-Saturator," Chem. Eng. Sci, 59:2821-2829 (2004). These two-phase systems only use enough hydrogen to saturate the liquid-phase in the reactor. As a result, the reactor systems of Schmidt et al. have the shortcoming that as the reaction proceeds and hydrogen is consumed, the reaction rate decreases due to the depletion of the dissolved hydrogen. As a result, such two-phase systems are limited in practical application and in maximum conversion rates.

Although a wide variety of process flow schemes, operating conditions and catalysts have been used in commercial petroleum hydrocarbon conversion processes, there is always a demand for new methods and flow schemes that provide more useful products and improved product characteristics. In many cases, even minor variations in process flows or operating conditions can have significant effects on both quality and product selection. There generally is a need to balance economic considerations, such as capital expenditures and operational utility costs, with the desired quality of the produced products.

There is a continuing need, therefore, for improved and cost effective methods to produce hydrocarbon streams that meet increasingly stringent product requirements. In particular, there is a need to provide ULSD in a cost effective and efficient manner without overtreating the heavier portions of the product streams.

SUMMARY

A process is provided to produce an ultra low sulfur hydrocarbon stream or an ultra low sulfur diesel (e.g., less than about 10 ppm sulfur) using a two-phase or liquid-phase continuous reaction zone with a hydrotreating catalyst at conditions effective to convert a diesel boiling range distillate to the ultra low sulfur levels and improved cetane numbers. In one aspect, the liquid-phase continuous reaction zone includes at least one, and preferably a plurality, of liquid-phase continuous reactors. The liquid-phase reactors are smaller and operate at less severe conditions than traditional three-phase or gas-phase systems. Therefore, ultra low levels of sulfur (e.g., less than about 10 ppm) with improved cetane numbers (greater than about 40) can be achieved without overtreating the hydrocarbonaceous streams as would be required in gas-phase systems. The liquid-phase reaction zone follows desulfurization and amine reduction of the hydrocarbonaceous feedstock to effect a product that provides the low levels of sulfur and amine compounds.

In another aspect, a hydrocarbonaceous feedstock is first reacted in a hydrodesulfurization zone, such as a hydrotreating unit and an optional mild hydrocracking unit, containing at least a hydrodesulfurization catalyst at conditions effective to produce a hydrodesulfurization zone effluent having a reduced concentration of sulfur of about 100 to about 2000 ppm. In such aspects, the hydrodesulfurization zone includes a hydrotreating zone and a hydrocracking zone.

The hydrodesulfurization zone effluent is then separated in a fractionating zone into at least a diesel boiling range distillate, which is a hydrocarbon stream having a mean boiling point of at least 265° C. (509° F.) and generally from 149° C. (300° F.) to about 382° C. (720° F.), and may also be separated into other fractions. Similarly, the diesel boiling point fractions may be combined with fractions having other boiling ranges depending on the application.

In this aspect, only the diesel boiling range distillate (or any additional fraction added thereto) is processed to achieve the ultra low sulfur levels and improved cetane rather than the entire hydrodesulfurization zone effluent. As a result, smaller and less costly reactors may be employed that require a much smaller demand of hydrogen. Moreover, reacting the diesel boiling range distillate rather than the entire hydrodesulfurization zone effluent to achieve ultra low levels of sulfur avoids overtreating any unconverted oil that would render it undesirable for fluid catalytic cracking.

The diesel boiling range distillate is over-saturated with hydrogen and reacted in the liquid-phase continuous reaction zone using a hydrodesulfurization catalyst to produce a liquid-phase effluent having the ultra low sulfur diesel (less than about 10 ppm sulfur) with an improved cetane number (about 40 or greater). Preferably, the diesel boiling range distillate is oversaturated in an amount effective to produce a liquid phase that has a saturated level of hydrogen throughout the reactor as the reaction proceeds. In other words, as the reactions consume dissolved hydrogen, the liquid phase is over saturated by an amount so that additional hydrogen is continuously available from a small gas phase entrained or otherwise associated with the liquid phase to dissolve back into the liquid phase to maintain the substantially constant level of saturation. Such levels of over saturation are generally achieved by the liquid-phase reaction zone being about 100 to about 1000 percent saturated, suitably at least 1000 percent saturated with hydrogen, and preferably, about 100 to about 600 percent saturated with hydrogen.

Thus, in this aspect, the over-saturated liquid phase preferably has a generally constant level of dissolved hydrogen from one end of the reactor zone to the other. Such hydrogen over-saturated liquid-phase reactors may be operated at a substantially constant reaction rate to generally provide higher conversions per pass and permits the use of smaller reactor vessels. In another aspect, such conversion and reaction rates allow the liquid-phase reaction zone to operate without a liquid recycle to achieve the desired USLD.

In an aspect, the diesel boiling range distillate feed is processed once-through in the liquid-phase continuous reaction zone. No ULSD product from a liquid-phase continuous reaction zone is recycled to the same liquid-phase continuous reaction zone. Hydrogen may also be processed once-through in the liquid-phase continuous reaction zone without recycle to the same zone.

In yet another aspect, the processes described herein require much lower hydrogen demands than traditional gas-phase systems to achieve the ultra low levels of sulfur. For example, the over saturated liquid-phase reaction zone uses about up to about 97 percent less hydrogen than gas phase reactors to achieve ultra low levels of sulfur. For example, a common trickle-bed, gas-phase reactor requires about 10,000 SCF/B of hydrogen while the over saturated liquid-phase reaction zone generally requires only about 300 to about 400 SCF/B of hydrogen. As a result, the hydrogen can be supplied to the liquid-phase reactors through a slip stream from a make-up hydrogen system and generally avoid the use of costly recycle gas compressors.

Other embodiments encompass further details of the process, such as preferred feedstocks, preferred hydrotreating catalysts, preferred hydrocracking catalysts, and preferred operating conditions to provide but a few example. Such other embodiments and details are hereinafter disclosed in the following discussion of various aspects of the process.

DETAILED DESCRIPTION

In one aspect, the processes described herein are particularly useful for hydrocracking a hydrocarbon oil containing hydrocarbons and/or other organic materials to produce a product containing hydrocarbons and/or other organic materials of lower average boiling point and lower average molecular weight having a reduced level of sulfur, and in particular, ultra lower levels of sulfur. The hydrocarbon feedstocks that may be subjected to hydrocracking by the methods of the invention generally include mineral oils and synthetic oils (e.g., shale oil, tar sand products, etc.) and fractions thereof.

Illustrative hydrocarbon feedstocks include hydrocarbonaceous streams having components boiling above about 288° C. (550° F.), such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils, cat cracker distillates, and the like. A preferred hydrocracking feedstock is a vacuum gas oil or other hydrocarbon fraction having at least about 50 percent by weight, and usually at least about 75 percent by weight, of its components boiling at a temperature above about 371° C. (700° F.). A typical vacuum gas oil normally has a boiling point range between about 315° C. (600° F.) and about 565° C. (1050° F.). These hydrocarbonaceous feed stocks may contain from about 0.1 to about 4 percent sulfur.

In one aspect, the selected hydrocarbonaceous feedstock is combined with a hydrogen-rich stream and then introduced into a hydrodesulfurization zone, which may include a mild hydrocracking unit, comprising a hydrotreating zone to remove hetero-atoms and an optional hydrocracking zone to break carbon bonds to form lower boiling hydrocarbons. For example, the feedstock is first introduced into the hydrotreating zone having a hydrotreating catalyst (or a combination of hydrotreating catalysts) and operated at hydrotreating conditions effective to provide a reduction in sulfur levels to about 100 to about 2000 ppm. In general, such conditions include a temperature from about 204° C. (400° F.) to about 482° C. (900° F.), a pressure from about 3.5 MPa (500 psig) to about 17.3 MPa (2500 psig), a liquid hourly space velocity of the fresh hydrocarbonaceous feedstock from about 0.1 $hr^{-1}$ to about 10 $hr^{-1}$. Other hydrotreating conditions are also possible depending on the particular feed stocks being treated.

As used herein, "hydrotreating" refers to a process wherein a hydrogen-containing treat gas is used in the presence of suitable catalysts which are primarily active for the removal of heteroatoms, such as sulfur and nitrogen from the hydrocarbon feedstock. The hydrotreating zone may contain a single or multiple reactor (preferably trickle-bed reactors) and reach reactor may contain one or more reaction zones with the same or different catalysts to convert sulfur and nitrogen to hydrogen disulfide and ammonia.

Suitable hydrotreating catalysts for use in the present invention are any known conventional hydrotreating catalysts and include those which are comprised of at least one Group VIII metal (preferably iron, cobalt and nickel, more preferably cobalt and/or nickel) and at least one Group VI metal (preferably molybdenum and tungsten) on a high surface area support material, preferably alumina. Other suitable hydrotreating catalysts include zeolitic catalysts, as well as noble metal catalysts where the noble metal is selected from palladium and platinum. It is within the scope of the processes herein that more than one type of hydrotreating catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, and preferably from about 2 to about 25 weight percent. While the above describes some exemplary catalysts for hydrotreating, other known hydrotreating and/or hydrodesulfurization catalysts may also be used depending on the particular feedstock and the desired effluent quality.

In one aspect, the hydrotreating zone effluent may be directly introduced into a hydrocracking zone to form lower boiling hydrocarbons. The hydrocracking zone may contain one or more beds of the same or different catalyst. For purposes herein, "hydrocracking" refers to a processing zone where a hydrogen-containing treat gas is used in the presence of suitable catalysts that are primarily active for the breaking of carbon bonds to form lower boiling hydrocarbons.

In one such aspect, the preferred hydrocracking catalysts utilize amorphous bases or low-level zeolite bases combined with one or more Group VIII or Group VIB metal hydrogenating components. In another embodiment, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to about 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006 to Rabo et al., which is hereby incorporated herein by reference in its entirety.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least about 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII (i.e., iron, cobalt, nickel, ruthenium, rhodium, palladium, osmium, iridium and platinum). In addition to these metals, other promoters may also be employed in conjunction therewith, including the metals of Group VIB (e.g., molybdenum and tungsten). The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 weight percent.

The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° to about 648° C. (about 700° to about 1200° F.) in order to activate the catalyst and decompose ammonium ions.

Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between about 5 and about 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 to Klotz, which is hereby incorporated herein by reference in its entirety.

By one approach, the hydrocracking of the hydrocarbonaceous feedstock in contact with at least a hydrocracking catalyst is conducted in the presence of hydrogen and preferably at hydrocracking reactor conditions effective for saturating the hydrocarbonaceous stream and to effect conversion of the stream to the diesel boiling range distillate (about 149° C. (300° F.) to about 382° C. (720° F.) and other, lighter products. In general, the hydrocracking zone may operate at a temperature from about 232° C. (450° F.) to about 482° C. (900° F.), a pressure from about 3.5 MPa (500 psig) to about 17.3 MPa (2500 psig), a liquid hourly space velocity (LHSV) from about 0.1 $hr^{-1}$ to about 30 $hr^{-1}$, and a hydrogen circulation rate from about 500 (84 normal $m^3/m^3$) to about 10000 (1700 normal $m^3/m^3$) standard cubic feet per barrel.

In another aspect, the resulting effluent from the hydrocracking zone is then introduced into a separation zone. By one approach, the effluent is first contacted with an aqueous stream to dissolve any ammonium salts and then partially condensed. The stream may then be introduced into a high pressure vapor-liquid separator operating to produce a hydrogen-rich gas stream boiling in the range from about 0° C. (30° F.) to about 32° C. (90° F.) and a liquid hydrocarbonaceous stream having a reduced concentration of sulfur and boiling in a range greater than the hydrogen-rich gas stream. By one approach, the high pressure separator operates at a temperature from about 38° C. (100° F.) to about 200° C. (400° F.) and a pressure from about 3.5 MPa (500 psig) to about 17.3 MPa (2500 psig) to separate such streams.

In yet another aspect, the vapor from the separator is preferably directed to an amine scrubber to remove contaminates, and then through a recycle gas compressor to be recycled back to the make-up hydrogen system and/or the hydrotreating reaction zone via a hydrogen recycle circuit. The liquid hydrocarbonaceous stream from the separator is preferably directed to a fractionation zone where the lighter products, such as diesel boiling range hydrocarbons, kerosene and naphtha, are separated from the heavier products, such as a fluid catalytic cracker (FCC) feed stream.

In another aspect, the diesel boiling range hydrocarbons (and any additional selected hydrocarbons), which are preferably separated as a distillate in the fractionation zone, are directed to a liquid-phase reaction zone at conditions effective to ultimately produce an effluent including the ultra low sulfur diesel (i.e., less than about 10 ppm sulfur) with improved cetane numbers (i.e., about 40 to about 60). Generally, the liquid-phase reaction zone is operated at a temperature from about 315° C. (600° F.) to about 400° C. (750° F.), a pressure from about 2.1 MPa (300 psig) to about 13.8 MPa (2000 psig) (preferably 3.5 MPa (500 psig) to about 6.2 MPa (9000 psig)), and a liquid hourly space velocity from about 0.5 $hr^{-1}$ to about 10 $hr^{-1}$ to produce the effluent with less than 10 ppm sulfur and cetane numbers from about 40 to about 60. The liquid-phase reaction zone preferably includes a hydrodesulfurization catalyst, which can be any of the previously described hydrotreating catalysts, in amounts effective to convert the diesel boiling distillate to ULSD with improved cetane numbers. However, other catalysts and/or operating conditions may also be used depending on the particular feed streams and desired product quality.

In yet another aspect, the diesel boiling range distillate (and any other selected distillate fractions) is saturated, and preferably, over-saturated with hydrogen prior to being introduced into one or more liquid-phase continuous reactors in the liquid-phase reaction zone. That is, in such aspect, the liquid-phase reaction zone also has a small vapor phase. In one such aspect, the liquid phase is over-saturated by adding an amount of hydrogen to the distillate stream effective to maintain a substantially constant level of dissolved hydrogen throughout the reaction zone as the reaction proceeds. Thus, as the reaction proceeds and consumes the dissolved hydrogen, there is sufficient over-saturation to continuously provide additional hydrogen to dissolve back into the liquid phase in order to provide a substantially constant level of dissolved hydrogen (such as generally provided by Henry's law, for example). In another aspect, the liquid phase remains substantially saturated with hydrogen even as the reaction consumes dissolved hydrogen. Such a substantially constant level of dissolved hydrogen is advantageous because it provides a generally constant reaction rate in the liquid-phase reactors.

In one such aspect, the diesel boiling range distillate or liquid phase is about 100 percent to about 1000 percent saturated, and, preferably, about 100 percent to about 600 percent saturated with hydrogen to achieve such levels of over saturation discussed above. In an aspect, the diesel boiling range distillate is at least about 1000 percent saturated with hydrogen. By one approach, at the liquid-phase reaction zone conditions discussed above, it is expected that about 300 to about 400 SCF/B of hydrogen will provide such over-saturation to the diesel boiling range distillate to maintain the substantially constant saturation of hydrogen throughout the liquid-phase reactor. This is about 97 percent less than more traditional gas phase reactors that require about 10,000 SCF/B of hydrogen. This reduced level of hydrogen can be provided by a slip stream from the hydrogen make-up system and, thus, avoids the use of costly recycle or hydrogen gas compressors. In such aspect, the hydrogen will comprise a bubble flow of fine or generally well dispersed gas bubbles rising through the liquid phase in the reactor. In such form, the small bubbles aid in the hydrogen dissolving in the liquid phase.

Accordingly, in this aspect, the relative amount of hydrogen required to maintain a liquid-phase continuous system, and the preferred over-saturation thereof, is dependent upon the specific composition of the hydrocarbonaceous feedstock, the level or amount of conversion to lower boiling hydrocarbon compounds, the composition and quantity of the lower boiling hydrocarbons, and/or the reaction zone temperature and pressure. The appropriate amount of hydrogen required will depend on the amount necessary to provide a liquid-phase continuous system, and the preferred over-saturation thereof, once all of the above-mentioned variables have been selected.

The diesel boiling range distillate is fed once-through to the liquid-phase continuous reaction zone. Because the diesel boiling range stream is sufficiently saturated with hydrogen, no effluent from the liquid-phase reaction zone which may comprise ultra low sulfur diesel is recycled back to the same reaction zone. The diesel boiling range distillate fed to the liquid-phase continuous reaction zone is absent liquid-phase reaction zone diesel effluent recycled from the same reaction zone. The diesel boiling range distillate fed to the liquid-phase reaction zone may also be absent hydrogen recycled from the same reaction zone. An effluent line from the liquid-phase continuous reaction zone is out of upstream communication with the liquid-phase continuous reaction zone. The term "out of upstream communication" means that no portion of the effluent from the liquid-phase continuous reaction zone flowing in the effluent line may operatively flow back to the same liquid-phase reaction zone.

Optionally, the liquid-phase reaction zone may include a plurality of liquid-phase continuous reactors in either a serial and/or parallel configuration. In a serial configuration, the effluent from one reactor is the feed to the next reactor, and in a parallel configuration, the feed is split between separate reactors. In each case, the feed stream to each reactor would be saturated, and preferably, slightly over-saturated with hydrogen so that each reactor has a constant amount of dissolved hydrogen throughout the reaction zone. The output from the liquid-phase reaction zone is an effluent having the ULSD with improved cetane number. Each of the liquid-phase continuous reactors operate once-through. No effluent from a liquid-phase continuous reactor is recycled to the same liquid-phase continuous reactor. However, effluent from one liquid-phase continuous reactor may flow to a downstream liquid-phase continuous reactor, but no effluent is recycled upstream of either reactor to enter the same reactor again.

BRIEF DESCRIPTION OF THE DRAWING

The FIGURE is a schematic view of the present invention.

DETAILED DESCRIPTION OF THE DRAWING

Turning to the FIGURE, an exemplary integrated hydrocarbon processing unit to provide ULSD will be described in more detail. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

With reference to the FIGURE, an integrated processing unit 10 is provided that includes a hydrodesulfurization zone 12, a fractionation zone 14, and a liquid-phase continuous reaction zone 16 that operate to produce at least an ULSD having less than about 10 ppm sulfur and a cetane number of about 40 to about 60. By one approach, the hydrodesulfurization zone 12 includes at least a hydrotreating zone 18 including a trickle-bed reactor(s) and an optional hydrocracking zone 20 including a trickle-bend reactor(s). The fractionation zone 14 includes a distillation column(s). The liquid-phase reaction zone 16 includes one or more liquid-phase continuous reactor vessels.

In one aspect, a feedstream preferably comprising vacuum gas oil is introduced into the integrated process 10 via line 22. A hydrogen-rich gaseous stream is provided via a hydrogen recycle line 24 and joins the feedstream to produce a resulting admixture that is transported via line 26 to the hydrotreating zone 18 of the hydrodesulfurization zone 12 to reduce the levels of sulfur to about 100 to about 2000 ppm. A resulting effluent stream is removed from hydrotreating zone 18 via line 28 and introduced into the hydrocracking zone 20 to provide a diesel boiling range distillate and other lighter products.

A resulting effluent stream from the hydrocracking zone 20 is preferably cooled and transported via line 30 into a high pressure separator 32 where a liquid hydrocarbonaceous stream is separated from a vapor or gas stream. The gas stream is removed from the high pressure separator 32 via line 34 and preferably fed to an amine scrubber 36 to remove sulfur components and then to a recycle gas compressor 38 via line 40. Thereafter, a hydrogen rich stream may be added back to the bulk hydrogen in line 24, also fed by a make-up hydrogen gas line 41 which is eventually added to the inlet of the hydrotreating reaction zone 18 of the hydrodesulfurization zone 12. The hydrodesulfurization zone 12 is in downstream communication with the recycle gas compressor 38. The term "downstream communication" means that at least a portion of material flowing to the hydrodesulfurization zone in downstream communication may operatively flow from the recycle gas compressor 38.

If needed, additional hydrogen may be provided from a make-up hydrogen system via line 41. Lines 24, 26, 28, 30, 34 and 40 and hydrodesulfurization zone 12, high pressure separator 32, amine scrubber 36 and recycle gas compressor 38 comprise a hydrogen recycle circuit.

The liquid stream from the separator 32 is routed via line 42 to the fractionation zone 14 where at least the diesel boiling range distillate is removed therefrom via line 44 and a higher boiling range hydrocarbonaceous stream is removed via line 46. By one approach, line 46 is introduced into a downstream fluid catalytic cracking unit (not shown).

The diesel boiling range distillate is directed in line 44 to the continuous liquid-phase reaction zone 16 from the fractionation zone 14. By a preferred aspect, the diesel boiling range distillate is saturated, and most preferably, over-saturated (about 100 to about 1000 percent saturation, preferably about 100 to about 600 percent saturation) and perhaps at least 1000 percent with hydrogen provided by a make-up hydrogen slip line 48 from the make-up hydrogen line 41 effective to permit the liquid-phase reaction zone 16 to operate with a substantially constant level of dissolved hydrogen (such as, for example, a hydrogen saturated liquid phase) even as the reactions consume the hydrogen because the oversaturation provides additional hydrogen to continuously redissolve back into the liquid phase. That is, for example, the reaction preferably proceeds in the liquid-phase reaction zone without additional sources of hydrogen external to the reactor. The liquid-phase continuous reaction zone 16 is out of downstream communication with the recycle gas compressor 38. In another aspect, the liquid-phase reaction zone 16 includes at least one, and preferably, two liquid-phase continuous reactors 50 connected in a serial arrangement.

As illustrated, if more than one reactor 50 is used in a serial arrangement, a liquid-phase effluent from a first liquid-phase reactor 52 is directed via line 54 to a second liquid-phase reactor 56. Prior to the second reactor 56, another hydrogen slip stream 58 from the hydrogen make-up system 41 is combined with line 54 to saturate, and preferably, over-saturate the hydrocarbons in line 54 in a manner similar to that with the first reactor. The resulting effluent from the second reactor 56 is withdrawn as the final product via line 60 and includes the ULSD having the improved cetane rating.

The diesel boiling range distillate and hydrogen in line 44 is fed once-through to the liquid-phase continuous reaction zone 16 and to first liquid-phase continuous reactor 52 and/or second liquid-phase continuous reactor 56. No effluent from the liquid-phase reaction zone 16 which may comprise ultra low sulfur diesel is recycled back to the reaction zone 16. No effluent from the first liquid-phase continuous reactor 52 which may comprise ultra low sulfur diesel is recycled back to the first liquid-phase continuous reactor 52. No effluent from the second liquid-phase continuous reactor 56 which may comprise ultra low sulfur diesel is recycled back to the second liquid-phase continuous reactor 56. The diesel boiling range distillate fed to the first liquid-phase reactor 52 is absent liquid-phase reaction zone diesel effluent and/or hydrogen recycled from the first liquid-phase reactor 52. The diesel boiling range distillate fed to the second liquid-phase reactor 56 is absent liquid-phase reaction zone diesel effluent and/or hydrogen recycled from the second liquid-phase reactor 56. The diesel boiling range distillate fed to the liquid-phase continuous reaction zone 16 is absent liquid-phase reaction zone diesel effluent and/or hydrogen recycled from the liquid-phase continuous reaction zone 16. An effluent line 60 from the liquid-phase continuous reaction zone 16 and second liquid-phase continuous reactor 56 is out of upstream communication with the liquid-phase continuous reaction zone 16 and second liquid-phase continuous reactor 56. An effluent line 54 from the first liquid-phase continuous reactor 52 is out of upstream communication with the liquid-phase continuous reactor 52. The term "out of upstream communication" means that no portion of the effluent from the liquid-phase continuous reaction zone 16, or a single reactor 52, 56 therein, flowing in the respective effluent line 54, 60 may operatively flow to the respective liquid-phase reaction zone 16, or a single reactor 52, 56 therein.

While the FIGURE illustrates two liquid-phase continuous reactors 50 in a serial arrangement in the reaction zone 16, it will be appreciated that this configuration is only exemplary and but one possible operating flowpath in this reaction zone. Depending on the particular flowrates, desired conversions, product compositions, and other factors, the liquid-phase reaction zone can include more or less reactors in either serial and/or parallel configurations.

The foregoing description of the FIGURE clearly illustrates the advantages encompassed by the processes described herein and the benefits to be afforded with the use thereof. In addition, the FIGURE is intended to illustrate but one exemplary flow scheme of the processes described herein, and other processes and flow schemes are also possible. It will be further understood that various changes in the details, materials, and arrangements of parts and components which have been herein described and illustrated in order to explain the nature of the process may be made by those skilled in the art within the principle and scope of the process as expressed in the appended claims.

The invention claimed is:

1. A process to produce low sulfur diesel comprising:

(a) converting a hydrocarbonaceous feedstock in a hydrodesulfurization zone containing at least a hydrodesulfurization catalyst operating at conditions effective to produce a hydrodesulfurization zone effluent having a reduced concentration of sulfur;

(b) separating the hydrodesulfurization zone effluent in a fractionating zone into at least a diesel boiling range distillate having a reduced concentration of sulfur;

(c) dissolving hydrogen in the diesel boiling range distillate, the hydrogen in a form that is available for consumption in a liquid-phase continuous reaction zone; and (d) feeding the diesel boiling range distillate once-through to a liquid-phase continuous reaction zone having a hydrodesulfurization catalyst using the hydrogen dissolved in the distillate at conditions effective to produce a liquid-phase reaction effluent having the low sulfur diesel with an improved cetane number over the diesel boiling range distillate, wherein the diesel boiling range distillate is fed to the liquid-phase continuous reaction zone with an absence of liquid-phase reaction zone diesel effluent recycled from the same liquid-phase continuous reaction zone or any other hydrocarbon stream.

2. The process of claim 1, wherein the liquid-phase reaction zone comprises one or more liquid-phase continuous reactors and an amount of hydrogen dissolved in the diesel boiling range distillate before entering each reactor effective to provide the reduction of the sulfur content in the distillate to less than about 10 ppm and an increase in cetane number of the distillate to greater than about 40.

3. The process of claim 1, wherein the diesel boiling range distillate is at least about 1000 percent saturated with hydrogen.

4. The process of claim 1, wherein the diesel boiling range distillate is fed to the liquid-phase continuous reaction zone with an absence of hydrogen recycled from the same liquid-phase continuous reaction zone.

5. The process of claim 4, wherein a reaction rate in the liquid-phase reaction zone remains substantially constant because consumed hydrogen in the liquid phase is replaced with hydrogen from a vapor phase.

6. The process of claim 5, wherein make-up hydrogen is fed to the liquid-phase reaction zone and hydrogen is recycled to the hydrodesulfurization zone.

7. The process of claim 1, wherein the hydrocarbonaceous feedstock boils in the range from about 315° C. (600° F.) to about 565° C. (1050° F.).

8. The process of claim 1, wherein the liquid-phase continuous reaction zone is operated at conditions effective to provide an effluent with a sulfur content below about 10 ppm and a centane number from about 40 to about 60.

9. The process of claim 8, wherein the conditions of the liquid-phase reaction zone include a temperature from about 315° C. (600° F.) to about 371° C. (700° F.), a pressure from about 2.1 MPa (300 psig) to about 13.8 MPa (2000 psig), a liquid hourly space velocity from about 0.5 $hr^{-1}$ to about 10 $hr^{-1}$, and about 100 to about 1000 percent saturated hydrogen.

10. The process of claim 9, wherein about 300 SCF/B to about 400 SCF/B hydrogen is supplied to provide the hydrogen dissolved in the diesel boiling range distillate.

11. A process to produce ultra low sulfur diesel comprising:

(a) reacting a hydrocarbonaceous feedstock in a hydrotreating zone containing a hydrotreating catalyst at conditions effective to produce a hydrotreating zone effluent having less than about 2000 ppm sulfur;

(b) reacting the hydrotreating zone effluent in a hydrocracking zone containing at least a hydrocracking catalyst to produce a hydrocracking zone effluent;

(c) separating the hydrocracking zone effluent in a fractionation zone into at least a diesel boiling range distillate;

(d) dissolving hydrogen in the diesel boiling range distillate, the hydrogen in a form that is available for consumption in a liquid-phase continuous reaction zone;

(e) feeding the diesel boiling range distillate to a liquid-phase continuous reaction zone having a hydrotreating catalyst at conditions effective to produce the ultra low sulfur diesel having less than 10 ppm sulfur and a cetane number greater than about 40; and (f) wherein the diesel boiling range distillate is fed to the liquid-phase continuous reaction zone without recycled hydrogen from the same liquid-phase continuous reaction zone and wherein the diesel boiling range distillate is fed to the liquid-phase continuous reaction zone with an absence of liquid-phase reaction zone diesel effluent recycled from the same liquid-phase continuous reaction zone or any other hydrocarbon stream.

12. The process of claim 11, wherein the hydrocarbonaceous feedstock includes at least 50 percent hydrocarbons with a boiling range above about 371° C. (700° F.).

13. The process of claim 11, wherein the liquid-phase continuous reaction zone is operated at a temperature from about 315° C. (600° F.) to about 400° C. (750° F.), a pressure from about 2.1 MPa (300 psig) to about 13.8 MPa (2000 psig), and a liquid hourly space velocity from about 0.5 $hr^{-1}$ to about 10 $hr^{-1}$.

14. The process of claim 11, wherein make-up hydrogen is fed to the liquid-phase reaction zone and hydrogen is recycled to the hydrodesulfurization zone.

15. The process of claim 11, wherein the diesel boiling range distillate is fed to the liquid-phase continuous reaction zone with an absence of hydrogen recycled from the same liquid-phase continuous reaction zone.

* * * * *